United States Patent [19]

Stolte

[11] Patent Number: 5,037,320

[45] Date of Patent: Aug. 6, 1991

[54] MODULAR JACK WITH INTEGRAL SHUNTING MEANS

[75] Inventor: Lodewijk J. C. Stolte, Rosmalen, Netherlands

[73] Assignee: AMP Corporated, Harrisburg, Pa.

[21] Appl. No.: 596,167

[22] Filed: Oct. 11, 1990

[30] Foreign Application Priority Data

Oct. 30, 1989 [GB] United Kingdom ..... 8924360

[51] Int. Cl.[5] ..... H01R 29/00

[52] U.S. Cl. ..... 439/188; 439/513; 439/676

[58] Field of Search ..... 439/188, 507, 513–515, 439/676, 668, 669

[56] References Cited

U.S. PATENT DOCUMENTS

| | | | |
|---|---|---|---|
| Re. 32,760 | 10/1988 | Chandler et al. | 439/188 |
| 3,954,320 | 5/1976 | Hardesty | 339/99 R |
| 3,998,514 | 12/1976 | Hardesty | 339/99 R |
| 4,193,654 | 3/1980 | Hughes et al. | 439/676 |
| 4,210,376 | 7/1980 | Hughes et al. | 339/17 LC |
| 4,231,628 | 11/1980 | Hughes et al. | 439/676 |
| 4,274,691 | 6/1981 | Abernethy et al. | 339/19 |
| 4,850,902 | 7/1989 | Reed | 439/676 |
| 4,863,393 | 9/1989 | Ward et al. | 439/188 |
| 4,874,333 | 10/1989 | Reed | 439/514 |

FOREIGN PATENT DOCUMENTS 0232981 8/1987 European Pat. Off. .

*Primary Examiner*—Paula A. Bradley

*Attorney, Agent, or Firm*—Bruce J. Wolstoncroft

[57] ABSTRACT

Electrical connector receptacle of the type used in the telecommunications industry comprise a one-piece molded housing having a plug-receiving end and a plug-receiving opening. A plurality of side-by-side conductors mounted in the housing have contact spring portions which extend into the plug receiving opening. Free ends of the contact springs are provided in recesses which are provided proximate the plug receiving opening. As the spring contacts are moved between a first position and a second position, the configuration of respective recesses causes the free ends of the contact springs to engage and disengage each other as required, thereby providing the shunting required for operation.

8 Claims, 3 Drawing Sheets

MODULAR JACK WITH INTEGRAL SHUNTING MEANS

FIELD OF THE INVENTION

The invention relates to an electrical connector for use in the data communications industry. In particular, the invention is directed to a modular jack which has means to insure that several of the contacts will engage each other when the modular jack is not mated with a modular plug.

BACKGROUND OF THE INVENTION

Modular jacks are well known in the industry. In particular, these types of connectors are used in the telecommunications industry to achieve standardization of a wide variety of types of equipment used by the industry and used in conjunction with communications equipment. Many of these connector receptacles or jacks are covered by patents such as U.S. Pat. Nos. 3,954,320, 3,998,514, 4,210,376, 4,496,991, etc.

Conventional jacks of this type, generally comprise a one-piece plastic housing having a longitudinal cavity adapted to receive the modular plug connector. Associated with the housing are a plurality of jack contacts, having one end adapted to engage the straight edges of the contact terminals of the plug connector when the later is inserted into the jack receptacle, and an opposed end adapted to be inserted into a printed circuit board. Each jack contact is held in place by slots or grooves formed in the jack housing.

In certain instances, it is desirable to provide such modular jacks, and other such communications equipment, with a shunting mechanism. The shunting mechanism cooperates with the jack contacts, when the modular plug is not inserted therein, to insure that at least two contacts are maintained in electrical engagement with each other. An example of a typical shunting member is described in U.S. Pat. No. Re. 32,760. However, a problem associated with this type of shunting member is the number of pieces which are required for operation, and consequently, the cost associated therewith.

In order to eliminate various parts of the connector, it would prove beneficial to have a modular jack which has a shunting means which is integral with the housing thereby eliminating the need for extra parts. This would greatly reduce the complexity and cost of the connector.

SUMMARY OF THE INVENTION

The invention is directed to an electrical connector receptacle which has inexpensive shunting means to insure that an electrical path is provided across various contacts, even when the mating connector is not inserted into the receptacle. In particular, an electrical connector receptacle of the type comprising an insulating housing having a plug receiving opening extending therein is described. The receptacle has a plurality of electrical conductors provided therein, the conductors are positioned in side-by-side spaced-apart relationship. Each of the conductors has a contact spring extending diagonally into the opening and towards the opposite internal sidewall. The plug-receiving opening is dimensioned to receive a connector plug having spaced-apart contact members therein which engage the contact spring portions of the conductors.

The connector receptacle is characterized in that free ends of the contact springs are provided in first and second recesses. The first and second recesses are provided adjacent the plug receiving opening. The second recesses are configured to allow the respective free ends of the spring contacts to be placed in electrical engagement with each other when the spring contacts are placed in a first position. As the spring contacts are moved from the first position to the second position, the configuration of the second recesses causes the respective free ends of the spring contacts to disengage from each other.

DETAILED DESCRIPTION OF THE DRAWINGS

Figure 1:
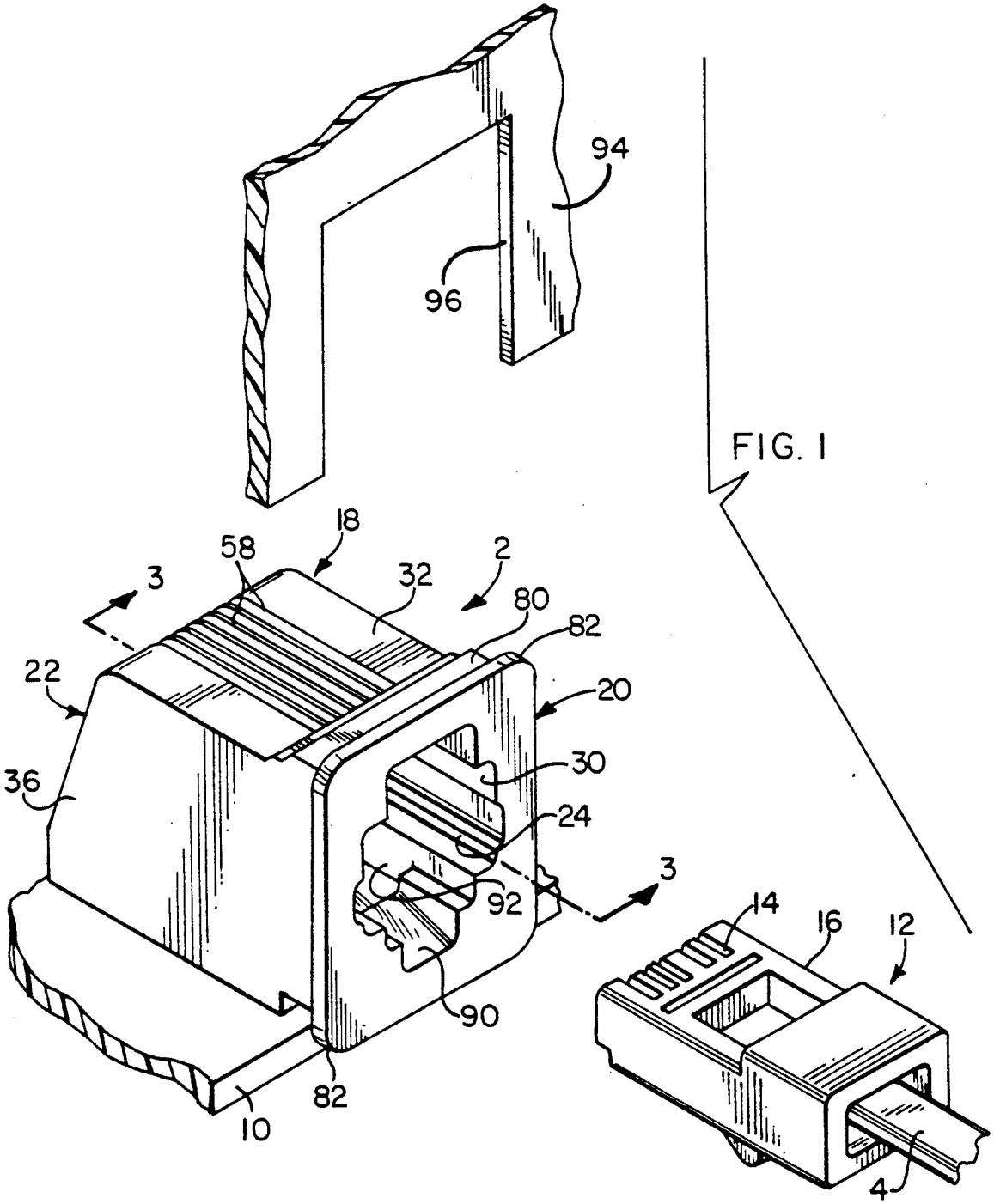
FIG. 1 is a perspective view of a connector receptacle in accordance with the invention, mounted on a circuit board and showing a portion of a panel and a connector plug exploded therefrom.
Figure 2:
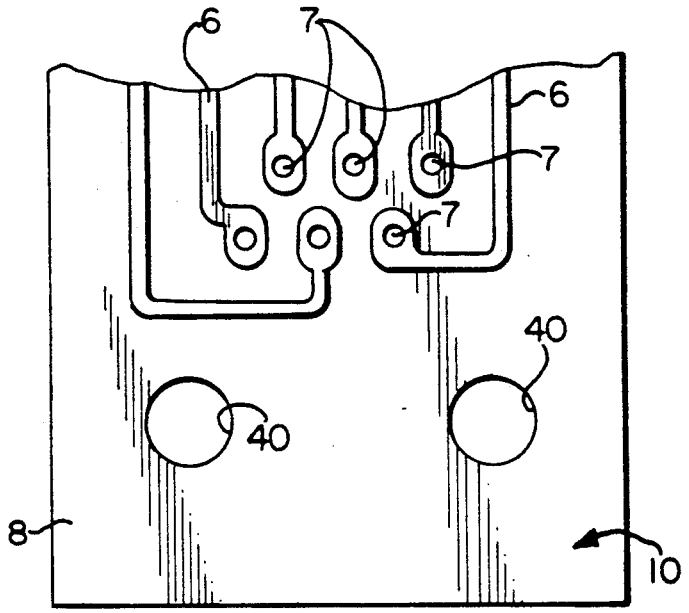
FIG. 2 is a plan view of the underside of a circuit board showing the conductors thereon and the pattern for the holes which receive the conductors of the receptacle.

Referring to FIGS. 1 and 2, an electrical connector receptacle or jack 2, in accordance with the invention, serves to connect conductors in a cable 4 to conductors 6 on the underside 8 of a circuit board 10. The conductors 6 extend to holes 7 in the circuit board which receive the end portions of conductors in the receptacle 2 so that the connector conductors can be soldered to the circuit board conductors 6. The cable 4 has a standard plug 12 on its end and the conductors in the cable are in electrical contact with contact members 14 which extend to the upper surface 16 of the plug. When the plug is inserted into the receptacle, the exposed contacts 14 are engaged with contact spring in the receptacle 2 as will be described below.

Figure 3:
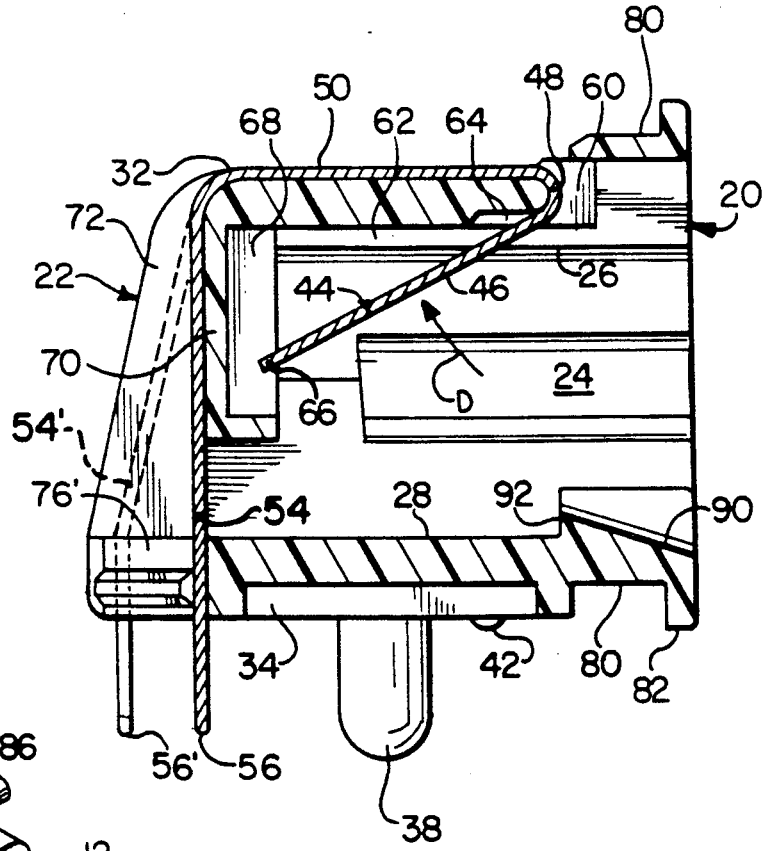
FIG. 3 is a cross-sectional view taken along the lines 3—3 of FIG. 1 but omitting the circuit board.

As best shown in FIGS. 1 and 3, the receptacle 2 comprises a one-piece molded housing 18 of suitable plastic material, such as a filled nylon, having a plug-receiving end 20, a rearward end 22, and having a plug-receiving opening 24 extending into the plug receiving end 20. The opening 24 has upper and lower internal sidewalls 26, 28 and opposed endwalls 30. The housing has upper and lower external sidewalls 32, 34 which are proximate to the internal sidewalls 26, 28 respectively and oppositely directed external endwalls 36. Mounting feet 38 extend from the lower external sidewall 34 and are dimensioned to enter spaced apart holes 40 (FIG. 2) in the circuit board 10 and stand-off bosses 42 are provided on the sidewall 34 to elevate this sidewall above the upper surface of the circuit board when the housing is mounted thereon.

A plurality of side-by-side stamped and formed conductors 44, FIGS. 1 and 2, are contained in, and on, the housing. The use of drawn wire conductors, as viewed in FIG. 7, may be preferred in certain circumstances. As best shown in FIG. 3, each conductor has a contact spring portion 46 having a free end 66, a reverse bend 48, an intermediate lead section 50 which extends rearwardly from the reverse bend 48, and downwardly extending lead portions 54, 54'. The lower ends 56, 56' of the portions 54, 54' are intended for insertion into the holes 7 of the circuit board and are offset from each other so that they can be received in circuit board holes which are arranged in a triangular pattern.

The sections 50 of the conductors are disposed in parallel side-by-side channels 58 (FIG. 1) in the upper external sidewall 32. These channels extend from the rearward end of the housing to spaced-apart apertures 60 (FIG. 3) which are adjacent to, but spaced from the plug-receiving end 20. These apertures are completely enclosed and the bent portions 48 of the conductors extend through these apertures and around conforming surfaces of the housing, as shown in FIG. 3. The internal sidewall 26 has space-apart recesses 62 which are dimensioned to receive the contact spring portions 46 of the conductors when the plug is inserted. Upon insertion of the plug the springs 46 are flexed upwardly, as indicated by the arrow D in FIG. 3, and resiliently engage the exposed contact members 14 of the plug. The recesses 62 are enlarged adjacent to the aperture 60, as shown at 64, to permit this flexure.

A plurality of parallel spaced-apart barriers 68 extend downwardly into opening 24 from the upper sidewall 26 adjacent to the rearward end 22 and these barriers define recesses 71, 71' which receive the free ends 66 of the contact springs 46. Additionally, a backwall 70 extends across the plug-receiving opening and downwardly, partially enclosing the plug-receiving opening at the rearward end.

Figure 6:
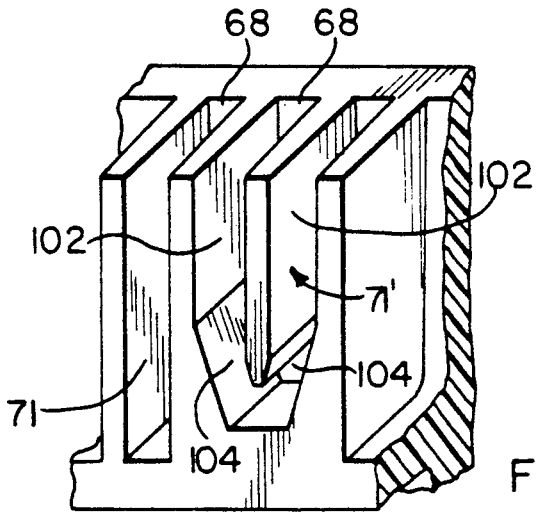
FIG. 6 is a fragmentary perspective view of the recesses of the connector with no conductors inserted therein.

As shown in FIG. 6, recesses 71 extend from internal sidewall 26 toward internal sidewall 28, in a direction which is essentially parallel to external endwalls 36. Recesses 71' also extend from internal sidewall 26 toward internal sidewall 28. A first portion 102 of each recess 71' extends essentially parallel to recesses 71. First portions are spaced from each other, with a respective barrier 68 provided therebetween. A second portion 104 of each recess 71' extends at an angle relative to the first portion. Adjacent recesses 71', as shown in FIGS. 6 and 7, are configured to be essentially mirror images of each other, with the second portion 104 of each recess being positioned in communication with each other, such that the adjacent recesses 71' form a continuous V-shaped recess.

Figure 7:
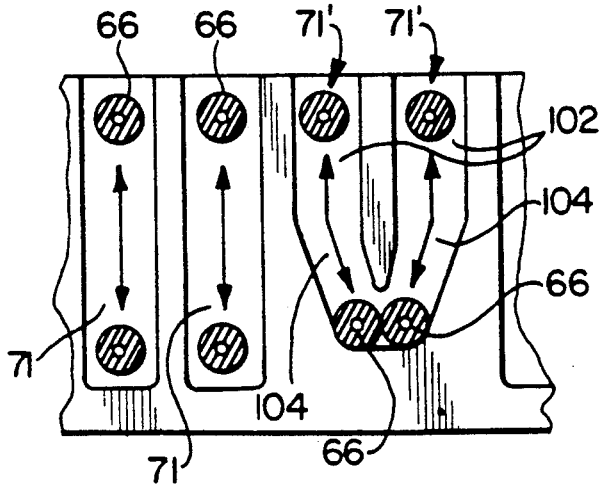
FIG. 7 is a diagrammatic view illustrating the movement of drawn wire conductors in the recesses of the connector.

The bottom or stop surfaces of recesses 71, as shown in FIGS. 6 and 7, are positioned closer to sidewall 28 than are the bottom surfaces of recesses 71'. Consequently, when the free ends 66 of the contact springs are positioned in recesses 71, 71', the free ends will assume the lower position as shown in FIG. 7. In this position, the free ends 66 of the contact springs which are provided in recesses 71 are positioned proximate the bottom surfaces. In this initial position, the contact springs are not positioned in engagement with the bottom surfaces, and therefore, the contact springs are not stressed. However the contact springs which are provided in recesses 71' are positioned in a stressed position. This is due to the fact that the bottom surface of the recess 71' is positioned closer to the sidewall 26 than the bottom surface of recesses 71. Therefore, as the respective contact springs are inserted into the recesses and moved toward their unstressed position, the free ends engage the bottom surface, preventing the further movement of the free ends, and maintaining the contact springs in a stressed position.

As is illustrated in FIG. 7, the free ends 66 of the spring contacts provided in the adjacent V-shaped recesses 71' are in electrical engagement with each other. When the free ends 66 of the spring contacts are inserted into the recesses 71', the resilient nature of the spring contacts causes the free ends 66 to move toward the bottom surface of the recesses. As this movement occurs, the walls of the second portions 104 of the recesses 71' causes the free ends 66 to move toward each other. This motion continues until the conductors cooperate with each other and the walls of the recesses to prevent further downward motion of the free ends. In this position, the spring contacts remain in a stressed position. It is important to note that although only two recess 71' are shown, any required amount of recesses 71' can be provided.

As best shown in FIG. 2, channels 72 are provided in the outwardly sloping rearward end of the housing adjacent to the external sidewall 32 and additional conductor-receiving channels 76 are provided in the rearward end adjacent to the lower external sidewall 34. The channels 76 alternate such that ever other channel is relatively deep while the remaining channels are comparatively shallow.

The conductors extend from the upper external sidewall 32 into the channels 72 and downwardly beyond the lower external sidewall 38. The downwardly extending portions of the conductors are spread apart in two senses: the center-to-center spacing between the conductors is increased and additionally the conductors 56 are offset from the conductors 56' so that the ends 56 and 56' will be received in holes 7 arranged on a triangular pattern. The deep channels 76 receive the conductors 56' and these conductors extend across the rearward surface of the wall 70 while the conductors 56 extend outwardly from this wall to the relatively shallow channels 76. Retaining lances (not shown) may be provided on the conductors adjacent to their lower ends 56, 56' to cooperate with the sidewalls of the channels 76, to retain the conductors in the channels.

Referring back to FIG. 1, the plug-receiving end of the housing has a continuous frame 80 which totally surrounds the plug-receiving opening 24. A flange 82 extends from this frame in all directions so that when the receptacle is mounted on a circuit board with the intention that a panel 94 be located adjacent to the edge of the circuit board, an opening 96 can be provided in the panel dimensioned such that the frame portion 80 is received in the opening. The flange 82 will then extend beyond the edges of opening 96 and present a pleasing and neat appearance from the outside of the panel. This arrangement thus facilitates manufacture of equipment using standard modular receptacles.

Figure 4:
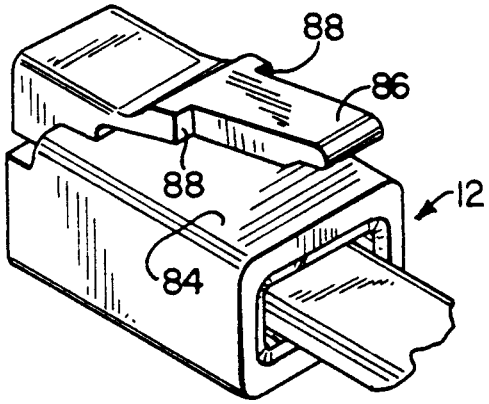
FIG. 4 is a view of a connector plug showing the latching arm thereof.
Figure 5:
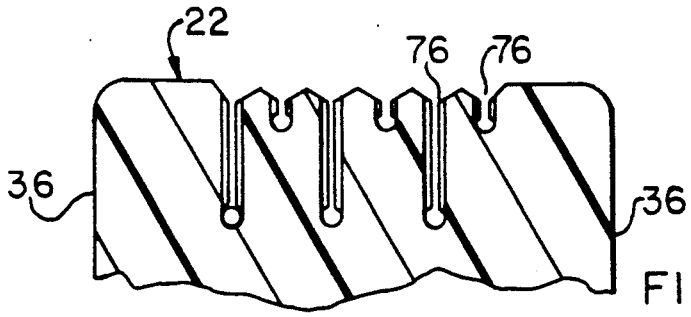
FIG. 5 is a view of the mounting section of an alternative embodiment of the connector, the mounting section configured to receive drawn wires therein.

The plug 12 has a latch arm 86 (FIG. 4) extending rearwardly from its side 84 and shoulders 88 are provided on this latch arm for latching the plug to the receptacle. The plug-receiving opening has an upwardly inclined ramp 90 at its mating end which extends to spaced-apart shoulders 92 which cooperate with the shoulders 88 on the plug receptacle.

In operation, plug 12 is inserted into jack 2. As the insertion occurs, plug 12 cooperates with the conductors 6 to flex the springs 46 in the direction indicated by the arrow D in FIG. 3, as was previously discussed. As the springs flex, they are moved from the lower position, shown in FIG. 7, to the upper position. This movement causes all springs 46 to assume a stressed position, which insures that the conductors 6 will make electrical engagement with contact members 14 of the plug 12.

It is important to note that as the springs 46 are moved from the lower position to the upper position, the free ends 66 of the contact springs which are provided in adjacent recesses 71' are moved apart. Consequently, adjacent spring contacts 46 are not provided in electrical engagement with each other when the plug is inserted into the jack.

Upon removal of the plug from the jack, the contact springs resiliently return to the lower position shown in FIG. 7. In this position, the free ends 66 of the springs provided in the adjacent recesses 71' are again placed in electrical engagement with each other, as was previously discussed Consequently, as electrical path is continually provided across the conductors positioned in recesses 71'.

Changes in construction will occur to those skilled in the art and various apparently different modifications and embodiments may be made without departing from the scope of the invention. The matter set forth in the foregoing description and accompanying drawings is offered by way of illustration only.

I claim:

1. An electrical connector receptacle of the type comprising an insulating housing having a plug receiving opening extending therein, a plurality of electrical conductors in side-by-side spaced-apart relationship, each of the conductors comprising a contact spring extending diagonally into the opening and towards the opposite internal sidewall, the plug-receiving opening being dimensioned to receive a connector plug having spaced-apart contact members therein which engage the contact spring portions of the conductors, the connector receptacle being characterized in that:

free ends of the contact springs are provided in first and second recesses which are provided adjacent the plug receiving opening, the second recesses having a configuration which allows the respective free ends of the spring contacts to be placed in electrical engagement with each other when the spring contacts are placed in a first position;

whereby as the spring contacts are moved from the first position to the second position, the configuration of the second recesses causes the respective free ends of the spring contacts to disengage from each other.

2. An electrical connector receptacle as set forth in claim 1 wherein the first and the second recesses are integral with the insulating housing.

3. An electrical connector receptacle as set forth in claim 1 wherein the second recesses have first portions which are spaced from and essentially parallel to each other, and second portions which extend from the first portions at an angle therefrom.

4. An electrical connector receptacle as set forth in claim 3 wherein the second portions of adjacent second recesses extend toward each other, such that respective ends of the second portions cooperate to form an opening between the recesses.

5. An electrical connector receptacle as set forth in claim 4 wherein the adjacent second recesses cooperate to provide a generally V-shaped recess which cooperates with the free ends from a pair of respective contact springs of the conductors.

6. An electrical connector receptacle as set forth in claim 1 wherein stop surfaces of the first and second recesses extend toward a bottom surface of the receptacle, the stop surfaces of the first recesses are positioned closer to the bottom surface than are the stop surfaces of the second recesses.

7. An electrical connector receptacle as set forth in claim 6 where the free ends of the spring contacts provided in the second recesses engage the stop surfaces of the second recesses when the spring contacts are in the first position.

8. An electrical connector receptacle as set forth in claim 7 wherein adjacent second recesses cooperate with each other proximate the stop surfaces to form an opening which extends therebetween, whereby the free ends of the spring contacts provided in the adjacent second recesses will be placed and maintained in electrical engagement with each other when the contacts are in the first position.

* * * * *

UNITED STATES PATENT AND TRADEMARK OFFICE

CERTIFICATE OF CORRECTION

PATENT NO. : 5,037,320

DATED : August 6, 1991

INVENTOR(S) : Lodewijk J.C. Stolte

It is certified that error appears in the above-identified patent and that said Letters Patent is hereby corrected as shown below:

On the Cover Page:

In Section [73] Assignee - delete "AMP Corporated" and insert --AMP Incorporated--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*